United States Patent [19]

Streich et al.

[11] Patent Number: 5,038,124

[45] Date of Patent: Aug. 6, 1991

[54] ELECTROMAGNETIC SWITCHGEAR

[75] Inventors: Georg Streich, Amberg; Guenter Gnahn, Sulzbach-Rosenberg; Kurt Held, Amberg, all of Fed. Rep. of Germany

[73] Assignee: Siemens Aktiengesellschaft, Berlin & Munich, Fed. Rep. of Germany

[21] Appl. No.: 403,685

[22] Filed: Sep. 5, 1989

[30] Foreign Application Priority Data

Sep. 5, 1988 [DE] Fed. Rep. of Germany ..... 8811207

[51] Int. Cl.[5] ..... H01H 67/02

[52] U.S. Cl. ..... 335/131; 335/157; 335/277

[58] Field of Search ..... 335/126, 131, 157, 193, 335/271, 277

[56] References Cited

U.S. PATENT DOCUMENTS 3,870,980 3/1975 Pollmann ..... 335/202
3,902,144 8/1975 Fischer et al. ..... 335/193
4,616,202 10/1986 Kakizoe ..... 335/131 X

FOREIGN PATENT DOCUMENTS 1151302 7/1963 Fed. Rep. of Germany .
2027136 9/1972 Fed. Rep. of Germany .
2248029 4/1974 Fed. Rep. of Germany .
2360907 12/1976 Fed. Rep. of Germany .
3335731 4/1985 Fed. Rep. of Germany .
3439788 4/1986 Fed. Rep. of Germany .
0951326 3/1964 United Kingdom .

*Primary Examiner*—George Harris
*Attorney, Agent, or Firm*—Kenyon & Kenyon

[57] ABSTRACT

An electromagnetic switchgear having a housing and a movable magnet part guided in the housing along a direction of motion. A contact bridge carrier is coupled to the movable magnet part and has openings. The housing has projections of different heights which extend through the openings in the contact bridge carrier and into sequential engagement with the movable part, to provide for switching-off with substantially reduced bouncing.

4 Claims, 2 Drawing Sheets

ELECTROMAGNETIC SWITCHGEAR

FIELD OF THE INVENTION

The present invention relates to electromagnetic switchgear, such as a contactor, with a movable magnet part that is guided in a housing and is coupled to a contact bridge carrier, and in which stops for stopping the motion of the movable magnet part are provided at the housing in the form of projections.

BACKGROUND OF THE INVENTION

In switchgear described in DE AS 1 151 302, the movable magnet part, (i.e., the first armature) is firmly connected via a plunger to the contact of the contact bridge. The contact operates as a make contact. The plunger is engaged by an armature return spring. A second armature which cooperates With the coil of the magnetic system is provided with posts to which springs are attached. In the rest position of the second armature, these springs push the second armature against the housing. The first armature in its rest position rests against stops provided on the housing. Since both armatures move when the magnetic system is being switched on, the springs acting on the posts of the second armature become contact pressure springs. The problem addressed by this known design is the prevention of bouncing during the switching-on process, without a cushioning contribution by the stops against which the first armature rests. This bouncing protection is needed since only make contacts are provided in the known design.

Switching-off bounce, on the other hand, occurs if the stops of the movable magnet part, provided the contact bridge carrier, consist of plastic. Such an arrangement is shown, for instance, in the switchgear described in German Examined Patent Application 23 60 907. There is a need to reduce the bounce that occurs during the switching-off process.

SUMMARY OF THE INVENTION

This and other needs are met by the present invention which provides switchgear having projections of different height that extend through openings in a contact bridge carrier surrounding the movable magnet part into engagement with the movable magnet part when the contact bridge carrier is reset. The friction between the plastic projections and the iron of the magnet part is utilized, while the energy absorption due to the different projection heights is sequential in time.

In order to use a conventional contact bridge carrier for ac magnets, i.e. a carrier which surrounds the ac magnet, the present invention is realized in the same manner in both aC and dc contactors. In an ac magnet embodiment of the present invention e.g., one of the general type shown in DE OS 3335731, the movable magnet part is a hinged armature of a dc magnet system for the switchgear. In this embodiment, the coupling between the armature and the contact bridge carrier takes place via a connecting arm through which a transverse latch extends. The transverse latch has free ends that rest in cutouts of the contact bridge carrier. The center of a leaf spring rests against the transverse latch, and has its ends located resting against the edges of the openings in the contact bridge carrier for the projections. In another embodiment of the invention, the transverse latch is adapted for the mounting of a movable ac magnet part.

DETAILED DESCRIPTION

Figure 1:
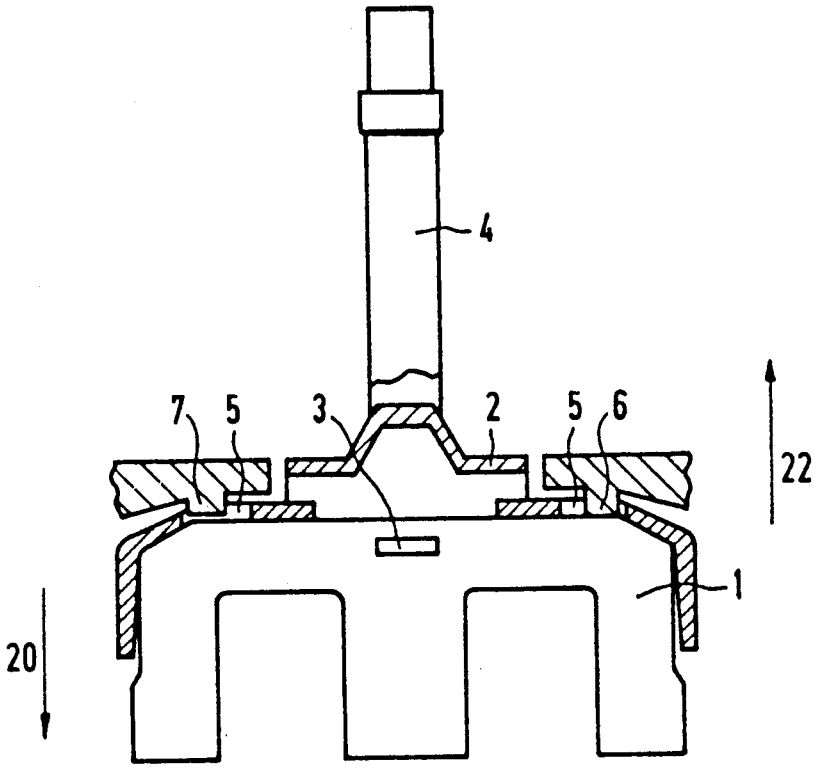
FIG. 1 illustrates a partially cross-sectional side view of an electromagnetic switchgear with an armature suitable for ac current constructed in accordance with an embodiment of the present invention.
Figure 2:
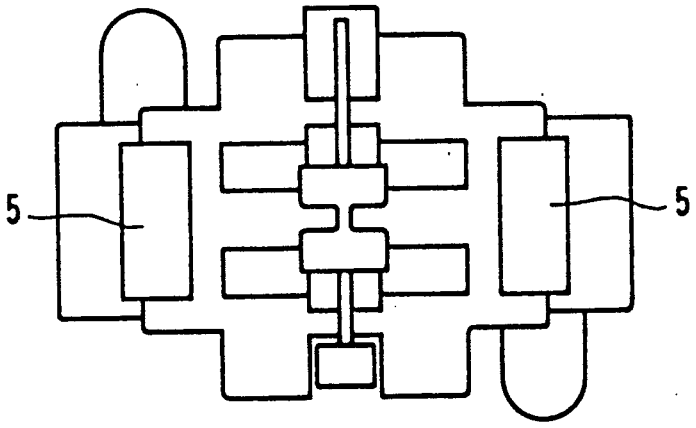
FIG. 2 is, a top view of a contact bridge carrier.

FIG. 1 illustrates a movable magnet part 1. This is the armature of an ac magnet system. The armature 1 is coupled by a transverse latch 3 to a contact bridge carrier 2 made of plastic. The transverse latch 3 extends through the armature 1 and is held at its ends in cutouts of the contact bridge carrier 2. As is shown in FIG. 2, the contact bridge carrier 2 is shaped like a tray with a turret-like extension 4 for mounting the contact bridges, not shown. The contact bridges can form make and break contacts with fixed contacts (also not shown). Energization of the ac magnet draws armature 1 and thus extension 4 in the direction of arrow 20 to make or break contact. Compression springs, not shown, move the armature 1, extension 4 and contacts carried thereby in the direction of arrow 22 when the ac magnet is deenergized to reset the contact bridge carrier 2. The contact bridge carrier 2 has openings 5 through which projections 6 and 7 can protrude. The projections 6 and 7 are formed at a housing, not shown in further detail, of the switchgear.

In the illustrated embodiment, the projection 6 is somewhat longer than the projection 7, so that during a switching-off motion of the armature 1 and movement in the direction of arrow 22, the projection 6 will come into contact with the armature 1 before the projection 7. After further motion, the projection 7 comes into contact with the armature 1 with a slight tilting motion, so that two sequential stops are provided.

Figure 3:
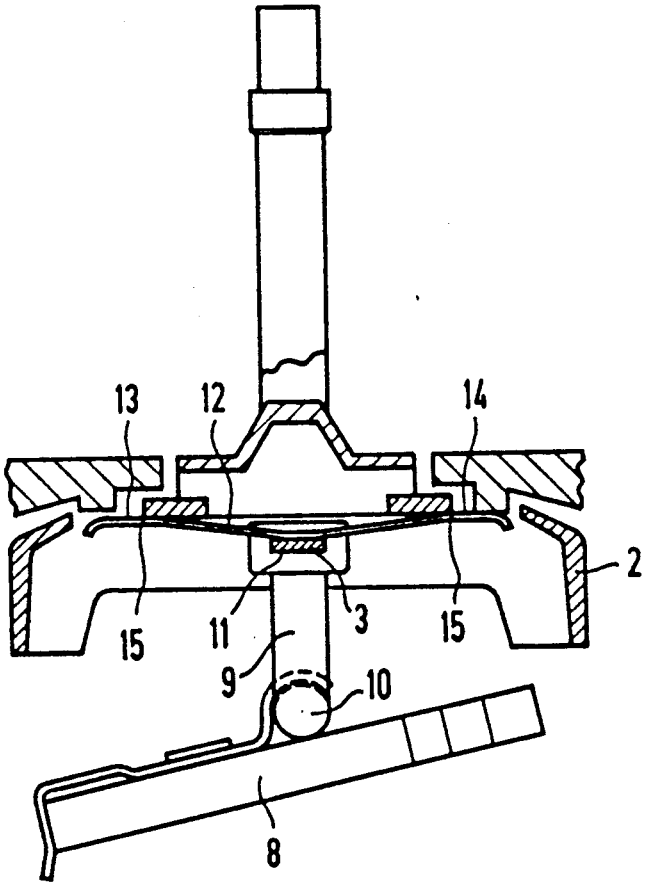
FIG. 3 illustrates a side view of another embodiment of the present invention that uses a hinged armature.

In the embodiment of FIG. 3, a hinged armature 8 for a dc magnet system is provided instead of the armature 1 of FIG. 1. The hinged armature 8 is coupled via a pivot 10 to a connecting arm 9. The connecting arm 9 couples the hinged armature 8 to the transverse latch 3 and to the contact bridge carrier 2. The transverse latch 3 extends through an opening 11 in the connecting arm 9 and is held by its free ends in the same cutouts of the contact bridge carrier 2 as in the embodiment of FIG. 1. In this embodiment, the stopping function is provided by a leaf spring 12 that is braced with its central part against the transverse latch 3. The free ends 13 and 14 of the leaf spring 12 rest against edges 15 of the openings 5 in such a manner as to come into contact with the projections 6 and 7 when the contact bridge carrier is reset. Thus, the operation of the projections 6 and 7 upon switching off the switchgear is the same as in the embodiment of FIG. 1 except that the spring ends of 13 and 14 of spring 12 rather than the armature is the surface against which the projections 6 and 7 act. Thus, according to the present invention, the upper part of the switchgear can be used for both ac and dc magnet systems.

What is claimed:

1. An electromagnetic switchgear comprising:

a housing;

a movable magnet part guided for movement in a first direction between an energized position and a deenergized position in said housing, said movable magnet part having associated therewith stop surfaces;

a contact bridge carrier;

said contact bridge carrier having openings therethrough overlying said stop surfaces;

means for coupling said contact bridge carrier to said movable magnet part, at least two projections of different heights extending from said housing generally in said direction and in alignment with said openings such that upon movement of said movable magnet part between one of its energized and deenergized positions and the other of said positions said projections come into sequential engagement with said stop surfaces.

2. The switchgear according to claim 1 and further including cutouts in said contact bridge carrier on opposite sides thereof along a line transverse to said first direction.

3. The switchgear according to claim 2, wherein the movable magnet part is the hinged armature of a dc magnet system wherein said means for coupling comprise:

a connecting arm having one end rotatably coupled to said hinged armature and a hole in the other end thereof;

a transverse latch having free ends, said transverse latch extending through said hole in said connecting arm with said free ends resting in the cutouts of the contact bridge carrier; and a leaf spring having ends located in front of and resting against edges of the openings in the contact bridge carrier, said leaf spring having a center that rests against the transverse latch, said leaf spring ends forming said stop surfaces.

4. The switchgear according to claim 1, wherein the movable magnet part is the armature of an ac magnet system and has a hole, and the contact bridge carrier has cutouts, and further comprising:

a transverse latch having free ends, said transverse latch extending through said hole in said armature with said free ends resting in the cutouts of the contact bridge carrier.

* * * * *